US005143579A

United States Patent [19]

Field et al.

[11] Patent Number: 5,143,579

[45] Date of Patent: Sep. 1, 1992

[54] TREATMENT OF BLACK LIQUOR WITH A SCREW EXTRUDER EVAPORATOR

[75] Inventors: Jasper H. Field, Goshen; Vladimir B. Lesokhin, Chester, both of N.Y.

[73] Assignee: International Paper Company, Purchase, N.Y.

[21] Appl. No.: 738,334

[22] Filed: Jul. 31, 1991

[51] Int. Cl.[5] ..... D21C 11/10

[52] U.S. Cl. ..... 162/30.1; 162/30.11; 159/2.2; 159/2.3; 159/47.3

[58] Field of Search ..... 162/30.1, 30.11, 31, 162/56; 159/47.3, 2.2, 2.3; 423/DIG. 3, 207

[56] References Cited

U.S. PATENT DOCUMENTS

| | | | |
|---|---|---|---|
| 1,852,264 | 4/1932 | Rinman . | |
| 1,934,957 | 11/1933 | Wells | 92/13 |
| 2,406,581 | 8/1946 | Bergstrom et al. | 23/18 |
| 2,534,324 | 12/1950 | Hildebrandt | 8/156 |
| 3,035,306 | 5/1962 | Rossiter | 18/12 |
| 3,084,107 | 4/1963 | McMahon | 202/48 |
| 3,392,004 | 7/1968 | Chari et al. | 23/248 |
| 3,420,626 | 1/1969 | Shick et al. | 23/129 |
| 3,507,742 | 4/1970 | Rice | 162/5 |
| 3,627,679 | 12/1971 | Fuller | 210/45 |
| 3,768,171 | 10/1973 | Bird et al. | 34/12 |
| 3,799,234 | 3/1974 | Skidmore | 159/2.2 |
| 3,912,580 | 10/1975 | Casten | 162/30 |
| 3,997,406 | 12/1976 | Arvanitakis | 202/175 |
| 4,244,779 | 1/1981 | Nieminen et al. | 162/30.1 |
| 4,446,094 | 5/1984 | Rossiter | 264/349 |
| 4,753,737 | 6/1988 | Staples et al. | 162/56 |

FOREIGN PATENT DOCUMENTS

| | | | |
|---|---|---|---|
| 57-149593 | 9/1982 | Japan . | |
| 2257491 | 11/1987 | Japan | 162/30.11 |
| 24125 | of 1913 | United Kingdom | 162/30.1 |

*Primary Examiner*—Karen M. Hastings

*Attorney, Agent, or Firm*—Luedeka, Hodges, Neely & Graham

[57] ABSTRACT

The specification discloses a method for the treatment of black liquor from a kraft or soda pulping process which comprises forcibly conveying the black liquor through an elongate conduit containing at least one vent at a position along its length while subjecting the black liquor to a working action and maintaining the temperature of the black liquor at least about 80° C. so that the black liquor is compressed and mixed as it is conveyed through the conduit to promote the separation of liquid components from the black liquor into the vent by expression and vaporization. As a result, the solids concentration of the material may be increased to provide an improved quality fuel for soda recovery boilers. The process is advantageously carried out using a vented screw extruder which is equipped to supply heat to the black liquor from the screw interiors and barrel housing to promote vaporization of volatiles and to maintain the flowability of the material as it is conveyed through the extruder.

15 Claims, 1 Drawing Sheet

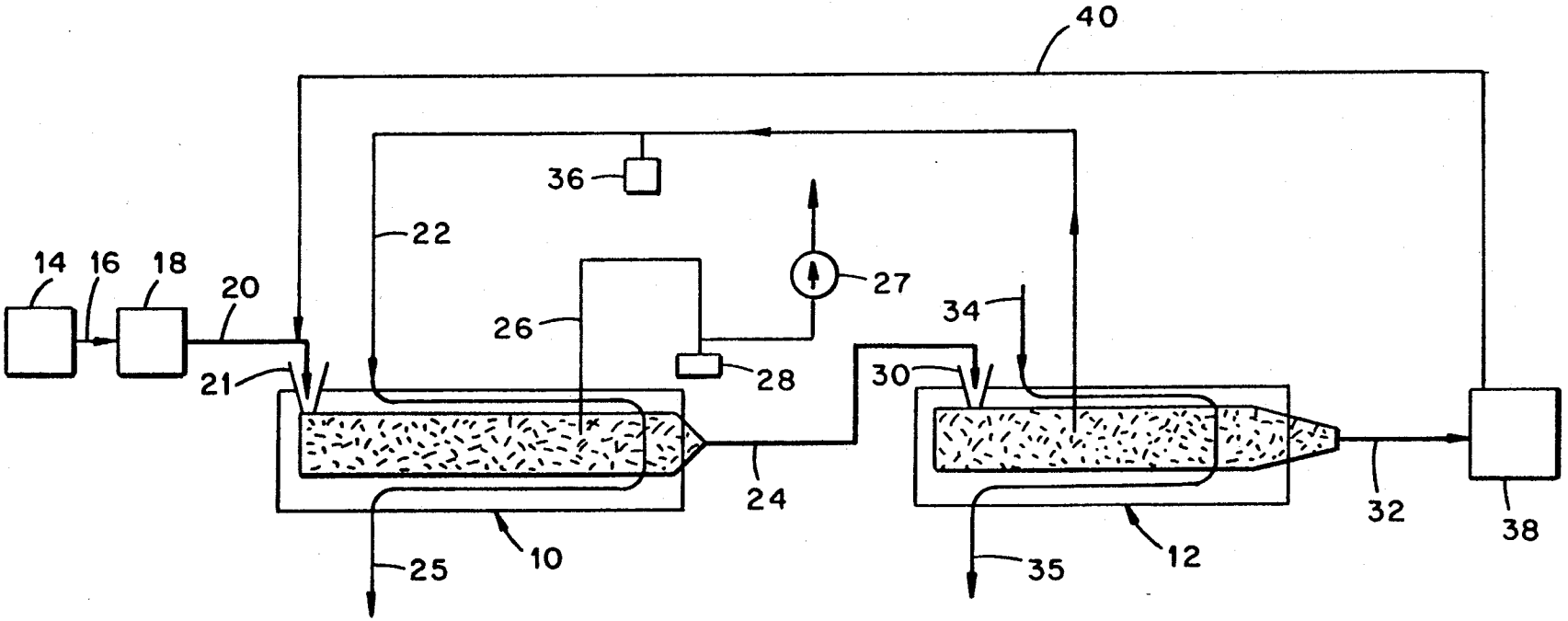
38
32
12
40
35
34
30
27
28
24
36
26
10
22
25
20
21
18
16
14

TREATMENT OF BLACK LIQUOR WITH A SCREW EXTRUDER EVAPORATOR

The invention relates to processes for the treatment of black liquor from a papermaking process and more particularly relates to a process for concentrating black liquor to a high solids content to enhance the usefulness of the material as fuel for soda recovery boilers.

Black liquor is a waste stream from the manufacture of kraft or soda pulp in a papermaking process. Black liquor typically contains about 15% solids consisting mainly of lignin and expended alkali compounds, and the balance water.

In a conventional kraft or soda pulp mill, black liquor is burned in a soda recovery boiler consisting of a steam generator and a smelting furnace for the utilization of the heat of combustion of the black liquor and the recovery of its inorganic components, particularly the sodium compounds. The solids concentration of the black liquor is normally increased to from about 50% to about 65% in an evaporator/concentrator prior to firing.

The efficiency of soda recovery boilers fueled with black liquor can be improved by firing an even more concentrated liquor than is achievable with concentrators. A known approach for further concentrating black liquor involves the use of thin-film evaporators which are capable of increasing the solids content to about 80% solids. However, the 80% solids material from such equipment is highly viscous and sticky, making it difficult to handle and feed to the boilers, and it still contains an undesirable percentage of water.

Accordingly, it is an object of the present invention to provide a method for the treatment of black liquor from a kraft or soda pulping process.

Another object of the invention is to provide a method for the treatment of black liquor to enhance the usefulness of the material as fuel for soda recovery boilers.

An additional object of the invention is to provide a method for the treatment of black liquor which enables the production of a highly concentrated black liquor feed for soda recovery boilers.

Still another object of the invention is to provide a method for the treatment of black liquor to enable the production of a highly concentrated black liquor boiler feed which is relatively easy to handle and feed into soda recovery boilers.

Yet another object of the invention is to provide a method for the treatment of black liquor used to fire soda recovery boilers wherein the properties of the black liquor feed are improved to improve the boiler efficiency.

The method comprises forcibly conveying black liquor through an elongate conduit containing at least one vent at a position along its length while subjecting the black liquor to a working action and maintaining the temperature of the black liquor at least about 80° C. so that the black liquor is compressed and mixed under the aforesaid temperature conditions as it is conveyed through the conduit to promote the separation of liquid components from the black liquor into the vent by expression and vaporization. As a result, the solids concentration of the material may be increased to provide an improved quality fuel for use in soda recovery boilers.

According to one aspect of the invention, black liquor at a conventional pre-firing concentration of from about 60% to about 65% solids may be concentrated to a solids concentration of at least about 90% and the resulting material is a relatively dry solid with a considerably increased heating value for firing into the boilers. A preferred apparatus for use in treating the black liquor in accordance with the invention is a screw-type extruder wherein the material is forcibly conveyed through a work space within the screw barrel and out a die by the advancing helix of a rotating screw located within the work space. A particularly preferred apparatus of this type is a screw extruder which is vented along its length and provided with internally heated screws. Heat energy from high pressure steam passing through the screw interior is transferred to the material in contact with the external surface of the screw, and a vacuum may be applied at the vents, so that the material undergoes processes of mechanical dewatering and vaporization essentially simultaneously as it is conveyed through the work space.

In a typical kraft or soda pulping process involving the generation of a black liquor waste stream, the black liquor from the pulper has a solids concentration in the neighborhood of about 15%. Generally, the black liquor is concentrated before it is fed to the soda recovery boilers by passage through multiple effect evaporators and a concentrator unit to provide an as-fired solids concentration of about 60% to 65% at a temperature of about 120° C. Since most paper mills are already equipped with multiple effect evaporators and concentrators for concentrating black liquor, it is advantageous to perform the method of the invention upon the black liquor stream as it exits the evaporator/concentrator units. Thus, the desired temperature for carrying out the treatment of the invention may be maintained in part by the sensible heat of the black liquor itself and there may be a decreased need for supplying external heat energy to the material, particularly in a continuous process where the material is received at an elevated temperature directly from the evaporator/concentrator unit.

BRIEF DESCRIPTION OF THE DRAWING

Various aspects of the invention are further illustrated in the drawing which is a diagrammatic view of a preferred apparatus that may be employed for carrying out the method. In this embodiment, the process of the invention is applied to the treatment of black liquor through the use of a series arrangement of vented screw extruder units 10 and 12 for stagewise concentration of the material.

DETAILED DESCRIPTION

Each extruder unit 10 and 12 is configured to forcibly convey the material through and along a heated, vented helical-shaped work space where the material is brought into pressing engagement with various adjacent surfaces upon the consequence of its movement, resulting in the application of a shear force to cause a working of the material so that it is, in effect, conveyed, squeezed, mixed and heated simultaneously. Both the housings and the screw interiors may be configured with conduits for heat transfer fluid, in this case steam, so that the material is heated from the outside and inside surfaces bounding the product space. This working and heating of the material combined with the venting and/or the application of vacuum from ports in the housing adjacent the work space causes the black liquor to undergo essentially a combination of mechanical dewatering and volatilization of liquid components as it is conveyed along the work space to a reduced diameter die opening at the end of the unit where the material is expelled at a substantially increased solids concentration.

In the embodiment described herein, black liquor is first directed from a kraft cooker 14 through conduit 16 to an evaporator/concentrator unit 18 where the solids concentration of the material is increased to about 65%. The black liquor exits the evaporator/concentrator unit 18 in conduit 20 at a temperature of about 120° C. and is delivered to the feed opening 21 of the first extruder unit 10.

The black liquor advancing through the first extruder unit 10 is heated indirectly by steam entering the spaces in the screw interiors and screw barrel from conduit 22.

The temperature of the steam in conduit 22 is sufficiently high to maintain the extruding material at a temperature of at least about 80° C., preferably at about 140° C., upon exiting the die at the end of the extruder unit 10 in conduit 24. As a specific example, the steam may be supplied at a temperature in the neighborhood of 110° C. and a pressure of above about 20 p.s.i. to maintain the material at a desired temperature for the extrusion process. The steam and any accompanying condensate exits unit 10 in conduit 25.

By the operation of the extruder unit 10 in concert with the heating and venting of the black liquor within its working space, the material simultaneously undergoes processes of mechanical dewatering and volatilization of liquid components to cause the extrudate exiting in conduit 24 to have a solids concentration in the neighborhood of about 75%.

Vapor and any expressed liquid is withdrawn from the initial extruder unit 10 through conduit 26. Removal may be assisted by a vacuum pump 27. Liquid components may be collected in condensate trap 28.

The extrudate from extruder unit 10 in conduit 24 is delivered to the feed opening 30 of the second extruder unit 12, where it is again forcibly advanced through the work space between the heated screws and barrel as described above to produce a further concentrated material in the form of a relatively dry extrudate emerging from the unit in conduit 32 with a solids concentration of 90% or more. Water removal is promoted in extruder unit 12 by maintaining the temperature of the extruding material at least about 80° C., and preferably at least about 140 C., by steam entering the screw interior and barrel housing from conduit 34 which passes from the unit 12 in conduit 35 together with any condensate.

The steam escaping to conduit 22 through the vents in the work space in the second unit 12 may be under pressure owing to the conditions in the work space. In a typical case, the steam pressure may be about 24 p.s.i. and the temperature may be about 115° C., thus providing a convenient and efficient means of supplying heat energy for maintaining the temperature of the black liquor in the first unit 10 at the desired level by recirculation of this steam to unit 10 in conduit 22 as shown in the drawing.

Any water or material in liquid form that may be expressed from the work space through the vent ports in unit 12 may be collected as in a condensate trap or collector 36 in communication with conduit 22.

At a solids concentration in excess of about 90%, the black liquor which emerges from the die of extruder unit 12 is in the form of a solid ribbon which may be collected in a storage bin, tank or the like or conducted directly to one or more soda recovery boilers indicated at 38 as a fuel with a substantially increased heating value relative to prior black liquor feeds. Alternately, and in accordance with a preferred embodiment, the solidified black liquor is first conducted to a grinder, roll crusher or other suitable apparatus to produce a pelletized feed which is more readily consumed in the boilers. In this respect, it is noted that the black liquor which emerges from the unit 12 at a solids concentration in the neighborhood of 90% becomes brittle upon cooling, and is readily pulverized to provide the desirable pelletized or powdered material having a high surface area to promote efficient combustion.

According to one feature of the invention, a portion of the concentrated black liquor from unit 12 may be recirculated to feed conduit 20 through conduit 40. This feedback loop arrangement enables enhanced control over the processing of the material in the extruder units since variations in the inlet concentration produce proportionately smaller changes in the outlet concentration, e.g., an increase in the inlet concentration from 60% up to 65% may cause only a relatively small increase in the outlet concentration of from 90% up to 91%, depending on the conditions. The insensitivity of the outlet concentration to changes in the inlet concentration is more pronounced for increases in the inlet concentration and it becomes greater as the outlet concentration approaches 100% solids. Thus, by recirculating the dried black liquor to the feed conduit, there is established a means for enabling precise control over the inlet feed concentration of the black liquor to compensate for any variations in the concentration from previous operations without significantly affecting the outlet concentration. Also, in the case in which it is determined that a certain feed concentration provides optimum efficiency for a given set of conditions and for a given equipment arrangement or type of equipment, this enables a convenient means for maintaining this feed concentration. The recirculation also enables a continuation of the treatment process or of dependent downstream processes, such as a soda recovery boiler, when the rate of delivery of black liquor from the evaporators or concentrators is reduced or interrupted.

Feedback may also be carried out with respect to a single extruder unit. For example, conduit 40 may communicate with conduit 24 delivering material to the second unit 12 or feedback may be provided from conduit 24 to conduit 20. In addition, feedback may be established from conduit 40 to both conduits 24 and 20, simultaneously.

Although the invention has been described in connection with a preferred embodiment, it is understood that the invention may take a variety of forms within the scope of the claims. For example, while an extruder is a preferred apparatus for carrying out the process, the invention resides not in the use of any particular apparatus but instead lies in the performance of operations upon the black liquor in accordance with the invention. Thus, one, two, three or any number and arrangements of extruders and other similar or different types of apparatus may be used to perform the method, and no undue limitations are to be implied from the descriptions contained in this specification.

The following non-limiting examples further illustrate various aspects of the invention. Unless otherwise indicated, all percentages are by weight and temperatures are in degrees Centigrade.

EXAMPLE 1

Black liquor samples were obtained from a kraft pulper and concentrated to obtain solids concentrations varying from 52% to 78% solids. The samples were submitted to a type-D Brabender screw extruder distributed by Brabender Instruments of South Hackensack, N.J. The extruder contained a 0.75 inch screw and had an L/D of 25 with 4-band zone heating by 600-Watt heaters, three along the barrel and one on the die head. The screw was driven by a 1.5 hp motor and the die head contained a single 0.25 inch opening.

Samples containing percentages of above about 70% solids were rolled into small pellets and fed continuously to the hopper. The lower solids content black liquor samples were poured into the hopper.

The extruding conditions and results are set forth below in Table 1.

TABLE 1

CONCENTRATING BLACK LIQUOR WITH A SCREW EXTRUDER

| Run No. | Feed Solids % | Feed Temp (°C.) | Screw RPM | Zone Temp °C. Zone 1 | Zone 2 | Zone 3 | Zone 4 | Extrudate Solids % |
|---|---|---|---|---|---|---|---|---|
| 1 | 78 | 25 | 30-70 | 140 | 140 | 140 | 140 | 92 |
| 2 | 78 | 25 | 50-70 | 140 | 140 | 140 | 140 | 92 |
| 3 | 78 | 140 | 50-70 | 140 | 140 | 140 | 140 | 92 |
| 4 | 52 | 25 | 10-100 | 140 | 140 | 140 | 140 | 89 |
| 5 | 78 | 25 | 50 | 120 | 120 | 120 | 120 | 84 |
| 6 | 78 | 25 | 50 | 150 | 175 | 200 | 200 | 98 |
| 7 | 65 | 25 | 50 | 140 | 140 | 140 | 140 | 90 |
| 8 | 73 | 25 | 50 | 140 | 140 | 200 | 200 | 95 |

The black liquor in run nos. 1-3 and 6-8 readily extruded to provide an extrudate resembling black toothpaste which cooled rapidly and became brittle. The extrudate was easily powdered in a Wiley mill. The powder absorbed moisture on standing and became slightly sticky. The working space became clogged in run nos. 4 and 5, the latter presumably being due to the relatively low temperature of 120° C. maintained in the extruder.

EXAMPLE 2

Black liquor samples were obtained from a kraft pulper and concentrated to obtain solids concentrations bearing from 62% to 63% solids. The samples were submitted to a twin-screw, corotating, vented extruder sold under the trade designation ZSK-30 by Werner and Pfleiderer Corporation of Ramsey, N.J. The specifications of the ZSK-30 extruder are set forth below in Table 2.

TABLE 2

TWIN-SCREW SPECIFICATIONS

| | |
|---|---|
| Screw Diameter: | 30 mm |
| Extruder L/D: | 36 |
| Screw Clearance: | approx. 0.5 mm |
| Screw rpm: | 150 |
| Barrel Sections: | 12 |
| Heating Zones: | 4 |
| Vent Ports: | 2 - equipment for vacuum devolatilization |
| Die Hard: | 2 × 3 mm dia holes |
| Feed Tank: | 15 gal, jacketed |

Table 3 shows the processing conditions and results of the tests.

TABLE 3

CONCENTRATING BLACK LIQUOR WITH A TWIN-SCREW EXTRUDER

| Run No. | Description | BL Feed Solids, % | Temp., °C. | Feed Rate, lb/hr | Screw, kW | Extruder Settings Zone Temps, °C. 1 | 2 | 3 | 4 | Die | Vacuum, in. 1 | 2 | Extrudate Output, lb/hr | Solids % |
|---|---|---|---|---|---|---|---|---|---|---|---|---|---|---|
| 1 | Initial Run | 63 | 71 | 17.4 | 1 | 69 | 134 | 111 | 102 | — | 5 | 10 | 13.2 | 91 |
| 2 | Throughput raised | 63 | 88 | 29.0 | 2 | 90 | 129 | 111 | 111 | — | Atmos. | 25 | 21.1 | 95 |
| 3 | Increased throughput | 63 | 90 | 46.4 | 1 | 73 | 125 | 110 | 100 | — | Atmos. | 25 | 35.4 | 85 |
| 4 | Highest throughput | 63 | 102 | 58.0 | 0.8 | 76 | 121 | 111 | 97 | — | Atmos. | 25 | 48.2 | 82 |
| 5 | Highest throughput | 63 | 107 | 58.0 | 0.8 | 77 | 120 | 109 | 98 | — | 3 | 25 | 45.2 | 82 |
| 6 | Highest throughput | 63 | 107 | 58.0 | 1.5 | 79 | 130 | 131 | 103 | — | Atmos. | 25 | 43.9 | 90 |
| 7 | Max. Solids | 63 | 103 | 29.0 | 1.5 | 94 | 113 | 140 | 121 | 146 | Atmos. | 19 | 20.8 | 97 |
| 8 | Increased throughput | 63 | 111 | 46.4 | 0.8 | 85 | 111 | 137 | 110 | 133 | Atmos. | 19 | 36.6 | 84 |
| 9 | Shortened barrel, single-stage vent | 63 | 104 | 29.0 | 1.2 | — | 98 | 145 | 109 | 113 | — | 19 | 27.0 | 83 |
| 10 | Shortened barrel, single-stage vent | 63 | 116 | 29.0 | 2.1 | — | 98 | 147 | 111 | 109 | — | 25 | 24.8 | 91 |

It is noted that the extruder was run at various arbitrary throughputs and the vacuum on vents 1 and 2, as well as the zone 2 temperature was adjusted to optimize venting (balancing flow rate, viscosity and vacuum to give the best seals at the vents). Temperature controls for zones 1, 3 and 4 were used only to maintain temperature and these elements were off most of the time since a jacketed feed pipe was used to maintain the feed at a temperature of about 130° C. Once steady-state was reached for a particular set of conditions, samples and readings were taken after 15 minutes of continuous operation. In runs 9 and 10 the effective barrel length was shortened by placing the black liquor feed pipe directly into the first vent port. Even with a barrel length of about 1½feet and single-stage fanning (at the second vent), solids as high as 90% were obtained.

In all cases, once the extruder settings had been established, the extrusion process ran smoothly to provide high solids extrudates. Leaving the extruder die, the hot black extrudate ribbon was quite thermoplastic (it could be tied into loose knots, for example), but rapidly became brittle on cooling and could then be broken into pieces or pulverized to a patter or pelletized form.

What is claimed is:

1. A method for treating black liquor from a kraft or soda pulping process wherein the black liquor is to be used as a fuel for a soda recovery furnace, the method comprising forcibly conveying the black liquor through an elongate conduit having an internal diameter and having a reduced diameter die opening at one end relative to the internal diameter of the conduit and containing at least one vent at a position along its length while maintaining the temperature of the black liquor at least about 80° C. so that the black liquor is progressively compacted as it is conveyed through the conduit toward the die opening to cause the separation of liquid components from the black liquor into the vent by expression and vaporization and cause the black liquor to be extruded from the die opening at an increased solids concentration, and using the extruded black liquor as a fuel for a soda recovery furnace, whereby the concentration of solid components in the black liquor is increased to provide an improved quality fuel for the soda recovery furnace.

2. The method of claim 1, further comprising applying a vacuum to the material through the vent in the conduit to further promote separation of liquid from the black liquor.

3. The method of claim 1, wherein the black liquor emerges from the conduit in an essentially solid form and wherein the invention further comprises pelletizing the solid black liquor to provide an improved quality fuel that is more easily metered into the soda recovery furnace and more readily combusted.

4. The method of claim 1, wherein the temperature of the black liquor is maintained at least about 120° C. in the conduit.

5. The method of claim 1, wherein the cross-section area of the conduit is tapered toward the direction of movement of the black liquor to provide a reduced area discharge opening for discharging of black liquor from the conduit and to cause a pressurization of black liquor advanced toward the discharge opening.

6. The method of claim 1, wherein the initial concentration of solids in the black liquor is at least about 50% and the black liquor is in an essentially liquid state, and a sufficient portion of the liquid is separated to cause the concentration of solids in the discharging black liquor to be at least about 90% such that the discharged black liquor is in an essentially solid state, whereby the black liquor is transformed from an essentially liquid state to an essentially solid state.

7. The method of claim 1, further comprising recirculating at least a portion of the black liquor of increased solids concentration to the conduit.

8. A method for the treatment of black liquor from a kraft or soda pulping process which comprises extruding the black liquor in a vented screw extruder so that the black liquor is subjected to compacting forces to cause expression of liquid from the black liquor into the vent to produce a black liquor extrudate having an increased solids concentration, said extruding of the black liquor taking place at a temperature at least about 80° C., and submitting the black quality fuel for the boiler.

9. The method of claim 8, further comprising evaporating water from the black liquor prior to the extrusion to provide an as-fed solids concentration of at least about 65% and wherein the extrusion of the black liquor further raises the solids concentration so that the black liquor extrudate has a solids concentration of at least about 90%.

10. The method of claim 8, wherein the solids concentration of the black liquor extrudate is at least about 90%.

11. The method of claim 8, further comprising applying a vacuum to the vent in the extruder to promote the separation of volatile components from the black liquor.

12. The method of claim 8, further comprising recirculating at least a portion of the extrudate to the extruder.

13. The method of claim 8, further comprising feeding the extrudate to a second vented screw extruder to further increase the solids concentration of the black liquor extrudate.

14. The method of claim 13, further comprising recirculating at least a portion of the extrudate from the second vented screw extruder to the feed to the first vented screw extruder.

15. The method of claim 13, further comprising heating the first and second vented screw extruders by circulating a heating fluid through the extruders whereby heat is transferred from the heating fluid to the black liquor being extruded and wherein vented components from the second vented screw extruder are used to supply at least a portion of the heat contained in the heating fluid circulated through the first vented screw extruder.

* * * * *